US005595347A

United States Patent [19]

Walpole

[11] Patent Number: 5,595,347

[45] Date of Patent: Jan. 21, 1997

[54] PROCESS FOR SEPARATING ILMENITE

[75] Inventor: Ernest A. Walpole, Lambton, Australia

[73] Assignee: Austpac Gold N.L., Sydney, Australia

[21] Appl. No.: 989,003

[22] PCT Filed: Aug. 28, 1991

[86] PCT No.: PCT/AU91/00401

§ 371 Date: Mar. 1, 1993

§ 102(e) Date: Mar. 1, 1993

[87] PCT Pub. No.: WO92/04121

PCT Pub. Date: Mar. 19, 1992

[30] Foreign Application Priority Data

| | | | |
|---|---|---|---|
| Aug. 30, 1990 | [AU] | Australia | PK 2031 |
| Apr. 29, 1991 | [AU] | Australia | 76298/91 |

[51] Int. Cl.[6] ..... B02C 19/00; B02C 19/12

[52] U.S. Cl. ..... 241/20; 241/23; 241/24.14

[58] Field of Search ..... 241/20, 23, 24, 241/24.14; 209/214, 215

[56] References Cited

U.S. PATENT DOCUMENTS

| | | | |
|---|---|---|---|
| 2,765,074 | 10/1956 | Diamond | 209/214 |
| 3,022,956 | 2/1962 | Haseman | 209/215 |
| 3,625,354 | 12/1971 | Heitmann | 209/3 |
| 4,158,041 | 6/1979 | Tolley | 423/80 |
| 5,035,365 | 7/1991 | Birmingham | 241/14 |
| 5,127,856 | 7/1992 | Oder | 241/24 |

FOREIGN PATENT DOCUMENTS

| | | |
|---|---|---|
| 1-84558 | 3/1977 | Australia . |
| 3403478 | 3/1978 | Australia . |
| 1-18835 | 4/1978 | Australia . |
| 5981490 | 1/1991 | Australia . |
| 1117766 | 2/1982 | Canada . |
| 1118213 | 2/1982 | Canada . |
| 856508 | 6/1940 | France . |
| 2043607 | 10/1980 | United Kingdom . |
| WO9004656 | 5/1990 | WIPO . |

OTHER PUBLICATIONS

"Letters to the Editor," *Physical Review*, vol. 108, No. 1, pp. 157–158, published Oct. 1, 1957.

"Ilmenite," pp. 555–558 (undated).

Hanlon, F. N., *Journal and Proceedings of the Royal Society of New South Wales for 1955*, vol. LXXXIX, Part I–IV, pp. 64–72.

Ishikawa, Y., et al. "Magnetic Property and Crystal Chemistry of Ilmenite ($MeTiO_3$) and Hematite (alpha–$Fe_2O_3$) System," Oct. 1958.

Ishikawa, Y., et al., "Magnetic Properties of $FeTiO_3$–$Fe_2O_3$ Solid Solution Series," vol. 12, No. 10, pp. 1084–1098, Oct. 1957.

*Primary Examiner*—John M. Husar

*Attorney, Agent, or Firm*—Edwin D. Schindler

[57] ABSTRACT

A process for enhancing ilmenite from deposits of mineral sands or mineral concentrates comprises a single stage fluidized bed magnetizing roast (16). A temperature of 650° C.–900° C. in an excess of a carbonaceous fuel (such as coal/char, CO or hydrocarbon) is used to provide an atmosphere in which the oxygen potential is controlled resulting in a consistently high magnetic susceptibility product. Roasting has been used before but the current process requires a lower intensity magnetic separation stage (18) and provides improved recovery (even of tailings produced by prior art roasting process). Annealing (17) of the roasted product improves the resultant magnetic susceptibility. Ilmenites having inclusions or selvedges of silicate minerals are further improved by employing a grinding step after magnetic separation prior to slagging or use as synthetic rutile feedstock. The roasting stage potentiates the ilmenite for leaching in the production of synthetic rutile.

31 Claims, 9 Drawing Sheets

Change in mass magnetic susceptibility with time at 750° C

Change in mass magnetic susceptibility with time at 800° C

Change in mass magnetic susceptibility with time at 850° C

PROCESS FOR SEPARATING ILMENITE

TECHNICAL FIELD

This invention relates to a process which enhances the extraction of ilmenite from deposits of mineral sands, or mineral concentrates thereof.

BACKGROUND ART

Mineral sands may contain many valuable minerals, among which are principally ilmenite, rutile, zircon, leucoxene, monazite and gold. These minerals are extracted by using differences in density and differences in the magnetic and electrical properties of the individual mineral species to separate them from the less valuable mineral components of the sands, and from each other.

Several prior art techniques are available for the separation of mineral sands into their valuable components. The most common method is generalized in FIG. 1 in block diagram form. The mineral sands are delivered as a wet raw sand to a gravity circuit (WET PLANT) to produce a coarse heavy mineral concentrate (HMC). This HMC may then be fed to a second stage where the magnetic properties of some of the component minerals are used to effect a further separation and concentration.

Ilmenite is a composite of iron and titanium oxides and is weakly magnetic. Highly magnetic minerals, such as magnetite, are removed from the HMC by a low intensity magnetic separator. The residual material may then be subjected to a wet high intensity magnetic separation (WHIMS) stage to concentrate the ilmenite. The WHIMS product may then be processed through an electrostatic stage in a DRY MILL.

The compound of particular interest for which ilmenite is the principal source is titanium dioxide, and the typical titanium dioxide concentration when the above prior art process is applied to ilmenite from the West Coast of The South Island of New Zealand ranges between 45%–47% $TiO_2$ with typical assays of silicon dioxide (silica) in the range of 4% to 6% and dialuminium trioxide (alumina) of 2% to 2.5%. By contrast, concentrates of West Australian ilmenites commonly contain $TiO_2$ in excess of 50%.

Due to the presence of iron oxides in ilmenite, the magnetic susceptibility of ilmenite can be increased by roasting under a variety of conditions. This increase in magnetic susceptibility is a well-known phenomenon and occurs through alteration of the chemical composition and crystalline structure, for example as discussed in the articles referred to below and allows the ilmenite to be readily separated from other minerals for example chromite, quartz, garnet and rutile, etc. by magnetic separation techniques.

One such prior art process is that operated by the Richards Bay Minerals (RBM) Company in South Africa which mines and treats raw sands which are high in chromite to recover ilmenite and other minerals. The raw sands are first processed through gravity and WHIMS circuits. The WHIMS separates the feed into non-magnetic and magnetic fractions, and the non-magnetic fraction, which contains rutile and zircon is then treated in a DRY MILL after being separated from the magnetic ilmenite/chromite fraction. The ilmenite/chromite fraction is roasted with excess oxygen at about 800° C. for 40 minutes. This magnetizes the ilmenite and allows it to be separated magnetically from the chromite as described at pp. 555–8 of "Magnetic Methods for the Treatment of Minerals", by J. Svoboda, Elsevier (1987), or Australian Patent 502866.

Another process is described in GB 2043607 which describes roasting an ilmenite ore in an hydrous atmosphere to enhance its magnetic susceptibility to separate it from rutile as an "impurity".

Besides the above patents, articles describing magnetising roasting known to the applicant are by Curnow & Parry (Nature, Dec. 11, 1954, p. 1101, Journal and Proc. of the Royal Society of N.S.W. Vol. 89 [1955] p. 64), Ishikawa and Akimoto (Journal of Physical Society of Japan Vol. 12 No. 10, Oct. 1957; Vol. 13, No. 10, Oct. 1958) and Bozorth, Walsh & Williams (Physical Review Vol. 108, No. 1, Oct. 1, 1957, p. 1083).

The process described by Curnow & Parry is one of oxidation in air at temperatures between 600° C. and 800° C. A ferric to ferrous ratio of 1.3 is achieved while prolonged roasting in excess of 800° C. produces only a weakly ferromagnetic resultant. This is much the same as the Richards Bay process.

Ishikawa describes using temperatures of 1100° C. for up to 12 hours and quenching to produce a solid solution of $xFeTiO_3(1-x)Fe_2O_3$ with maximal magnetic properties when $1.0>x>0.5$. Ishikawa is also referred to in Bozorth et. al. which is concerned with the magnetization of ilmenite at low temperatures.

Ilmenite deposits are found in many countries for example South Africa, United States of America, Australia, India, New Zealand and other areas of the world. The ilmenite deposits in various countries and locations can differ in their compositions.

In particular the ilmenite found in the South Island of New Zealand contains abundant inclusions and selvedges of silicate minerals. Metallurgically these inclusions have the effect of lowering the magnetic susceptibility and conductivity of grains of ilmenite containing inclusions, while enhancing the content of silica and alumina and other deleterious compounds in an ilmenite concentrate with a consequent relative depletion of the titanium dioxide content. Such composite grains can be difficult to separate magnetically or electrostatically, and can result in lower than average yields and higher than average capital and direct operating costs than are usual in the mineral sands industry.

The South Island of New Zealand ilmenites also occur in common association with abundant garnet. The garnet has a specific gravity and size range close to that of the ilmenite and this also creates problems in the first stage of gravity separation in the known processes. The magnetic susceptibility and conductivity of this garnet are also close to those of the ilmenite such that the employment of the known separation stages is costly while the loss of ilmenite from the process is also high.

Because the silicate inclusions give significant "inbuilt" levels of silica and alumina in a slag or synthetic rutile feedstock, it is important to remove discrete crystals such as garnet, quartz or other deleterious silicate minerals in the mineral dressing process. The conventional mineral dressing process as shown in FIG. 1 can remove nearly all the unwanted discrete minerals from a West Coast South Island of New Zealand mineral sand but at the cost of an overall recovery ranging from 65% to 75% of the ilmenite. The best ilmenite concentrate that can be achieved may contain from about 1% to 2% of discrete silicate minerals and will assay approximately 46.5% to 47% titanium dioxide. When this concentrate is processed in an electric arc smelting furnace it can provide, according to FIG. 3, an equivalent of approximately 73%–83% titanium dioxide in slag, depending on the level of iron (FeO) in the slag acceptable in the slag-making process and to the consumer.

DISCLOSURE OF INVENTION

The present invention seeks to overcome these disadvantages in the prior art and to provide an improved process for the separation of ilmenite ores from raw sands including those with high garnet content or minerals such as chromite that does not utilize the conventional WHIMS or DRY MILL processes.

Another object of the invention includes enhancing the $TiO_2$ content by removing silicate selvedges and inclusions, where such are present.

According to a first aspect of the invention there is provided a process for the separation of ilmenite from raw sand, or mineral concentrates thereof, which includes the steps of, in sequence:

a specific gravity separation stage;

a low intensity magnetic separation stage;

a single stage magnetising roast at a temperature in the range 650° C.–900° C. using an excess of carbon as hereinafter defined to provide an atmosphere in which the oxygen potential is controlled; and a low to medium intensity magnetic separation stage.

According to a second aspect of the invention there is provided a process for the separation of ilmenite from raw sand, or mineral concentrates thereof, which includes the steps of, in sequence:

a specific gravity separation stage;

a low intensity magnetic separation stage;

a single stage magnetising roast at a temperature in the range 650° C.–900° C. using an excess of carbon as hereinafter defined to provide an atmosphere in which the oxygen potential is controlled;

a cooling stage comprising cooling of the roasted ore under controlled conditions; and a low to medium intensity magnetic separation stage.

The cooling stage may be performed gradually, for example over a period of one and a half hours to cool the roasted ore to ambient temperature, or may be performed rapidly while preventing oxidation, for example by forced cooling within 15 minutes either directly or indirectly with water or a neutral gas so as to prevent contact with oxygen or air.

According to a further aspect of the invention there is provided a process for the separation of ilmenite from raw sand, or mineral concentrates thereof, of the type having a high relative concentration of deleterious silicates (including garnet) including the steps of, in sequence:

a specific gravity separation stage;

a low intensity magnetic separation stage;

a single stage magnetising roast at a temperature in the range 650° C.–900° C. using an excess of carbon as hereinafter defined to provide an atmosphere in which the oxygen potential is controlled;

a low to medium intensity magnetic separation stage;

a grinding stage; and a low to medium intensity wet magnetic separation stage.

An attritioning stage may be introduced between the magnetising roasting and the low to medium intensity magnetic separation stages with or without a cooling stage.

PREFERRED MODES FOR CARRYING OUT THE INVENTION

Figure 2:
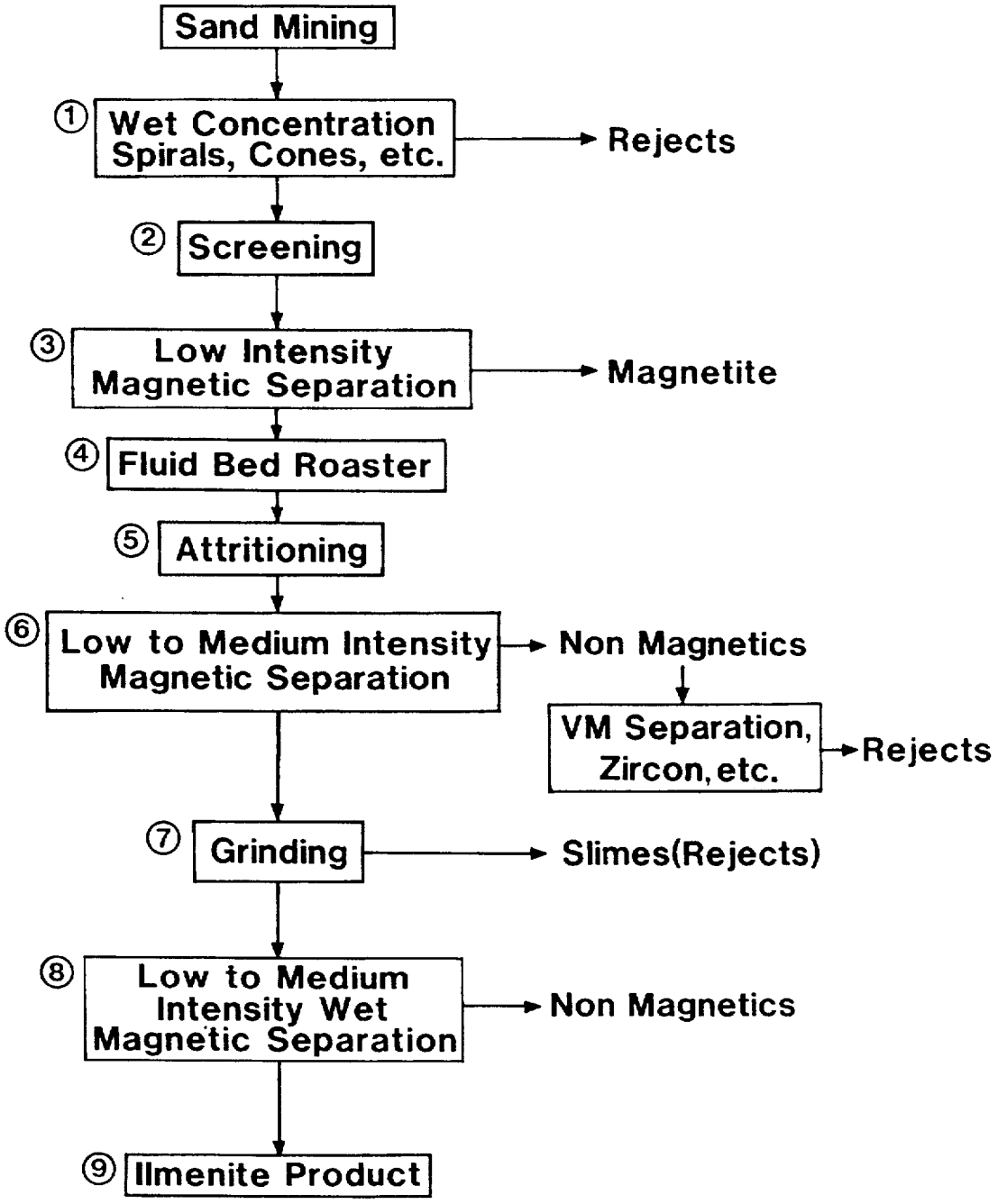
FIG. 2 is a block diagram of a first embodiment of the process according to the present invention.
Figure 3:
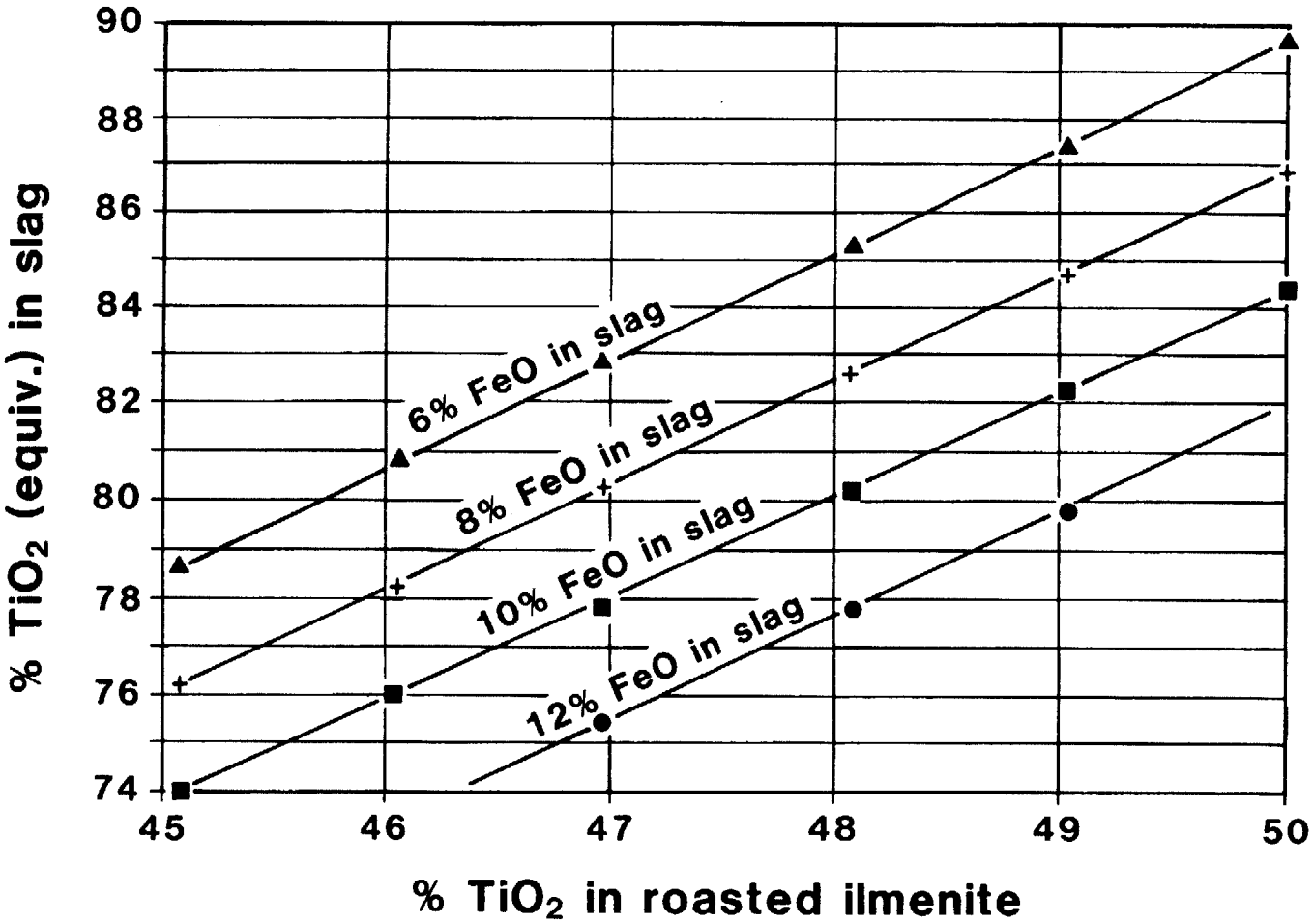
FIG. 3 is a diagram relating % titanium dioxide in ilmenite to % titanium dioxide content in slag.

As shown in FIG. 2 the process according to one aspect of the invention relates to the processing of ilmenite in deposits with high relative concentration of silicate and garnet materials and comprises the conventional step of first passing the raw sand through a wet gravity concentration stage (step 1), followed by screening (step 2), and the removal of the highly susceptible minerals such as magnetite by low intensity magnetic separation (step 3). The resulting product is then passed through a roaster, (step 4), in which the temperature, oxygen potential, and residence time are carefully controlled. The roaster product may then be attritioned (step 5), and then passed to a low to medium intensity magnetic separation stage, (step 6). Though a fluid bed roaster is shown in FIG. 2, any type of roaster within the knowledge of a person skilled in the art may be employed, for example a rotary kiln.

Depending on the characteristics of the ore being treated, it may not be necessary to screen (step 2) or attrition (step 5), or grind (step 7) the ore.

Concentrates from step 6 show a significant improvement in the recoveries of ilmenite, as compared to levels achievable by conventional methods.

In the roasting operation, (step 4), the magnetic susceptibility of the ilmenite fraction can be enhanced by a factor of up to 50, depending on the atmosphere and other factors selected, whilst the magnetic susceptibility of the silicate and other deleterious minerals, including garnet, remains virtually unchanged.

Following the roasting operation, (step 4), and attritioning, (step 5), the enhanced magnetic susceptibility enables a clean separation of the ilmenite fraction from the other mineral components, using a low to medium intensity magnetic separation (step 6).

The flowsheet outlined above in effect does away with the primary WHIMS/DRY PLANT beneficiation concentration procedures in common use in the mineral sands industry worldwide and replaces them with a roasting/low to medium intensity magnetic separation.

The process also pretreats ilmenite for the manufacture of synthetic rutile, or for the manufacture of titania slag.

With respect to New Zealand South Island ilmenite, reduction in the garnet and silica components of the resulting concentrate optimises the smelter feed in the slag-making process, and the quality of the final ilmenite product is greatly enhanced by introducing a grinding stage, (step 7), as shown in FIG. 2. After grinding, a high quality concentrate is then achievable with only about a 3% by weight loss. This loss is understood to be mostly accounted for by the removal of deleterious silicate material still persisting in the concentrate prior to the grinding stage, (step 7), and of some of the silicate inclusions and some of the silicate selvedges attached to the edges of the ilmenite grains. The output from the grinding, (step 7), is then passed through a low to medium intensity wet magnetic separation (step 8).

The resultant ilmenite product (9) shows an enhanced concentration of the titanium dioxide as shown in Table 1.

The inventive process results in an assay of the resulting ilmenite product (9) of approximately 49% titanium dioxide compared with the assay employing the conventional process of approximately 46.5%. In addition, the silica and alumina concentrations are significantly reduced, and these differences provide substantial commercial advantages over the conventional heavy mineral sand processing methods. The inventive process allows a lower grade HMC to be accepted from the Wet Plant or gravity-processed stage, (step 1), than would normally be desirable.

For example, a 25% (approx.) ilmenite concentrate can be acceptable compared with a 35% (approx.) ilmenite concentrate in the prior art techniques. In such a circumstance recoveries can be increased by approximately 4% overall, while reducing capital and operating costs.

TABLE 1

Figure 1:
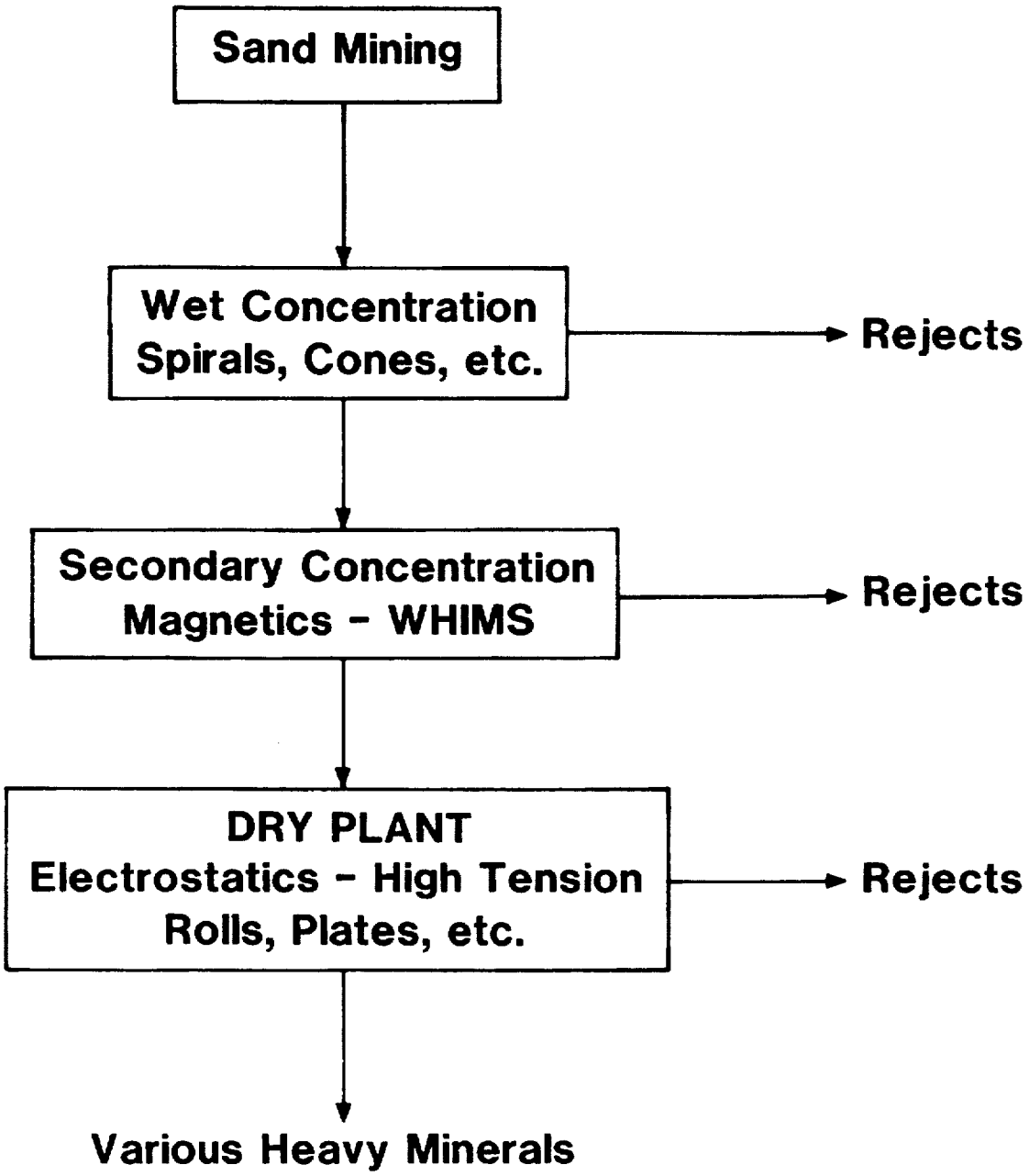
Figure 1 PRIOR ART
FIG. 1 is a block diagram of a conventional separation process.

| | COMPARATIVE ASSAYS | |
|---|---|---|
| | Product of Flowsheet of FIG. 2 | Product of Conventional Flowsheet of FIG. 1 |
| $TiO_2$ | 48.9% | 46.6% |
| $SiO_2$ | 3.8% | 4.78% |
| $Al_2O_3$ | 1.17% | 1.95% |

The known techniques for the separation of ilmenite from mineral sands with high concentration of garnet may result in low recoveries of ilmenite and may require a large and costly DRY MILL to remove the volume of garnet waste.

The inventive process does not require a WHIMS or DRY MILL process. Overall recoveries of ilmenite are significantly enhanced and consequently the overall direct operating costs are lower than for conventional processes, and the mineable reserves of deposits are extended.

Depending on the type of ore being treated, the roasting temperature, (step 4), can range between 650° C. to 900° C. (but preferably is in the range 750°–850° C.), and residence time can range between 30 minutes and 90 minutes.

The wide temperature range and long residence time has the advantage of simplifying operating conditions and thereby allowing ease of control.

Figure 5:
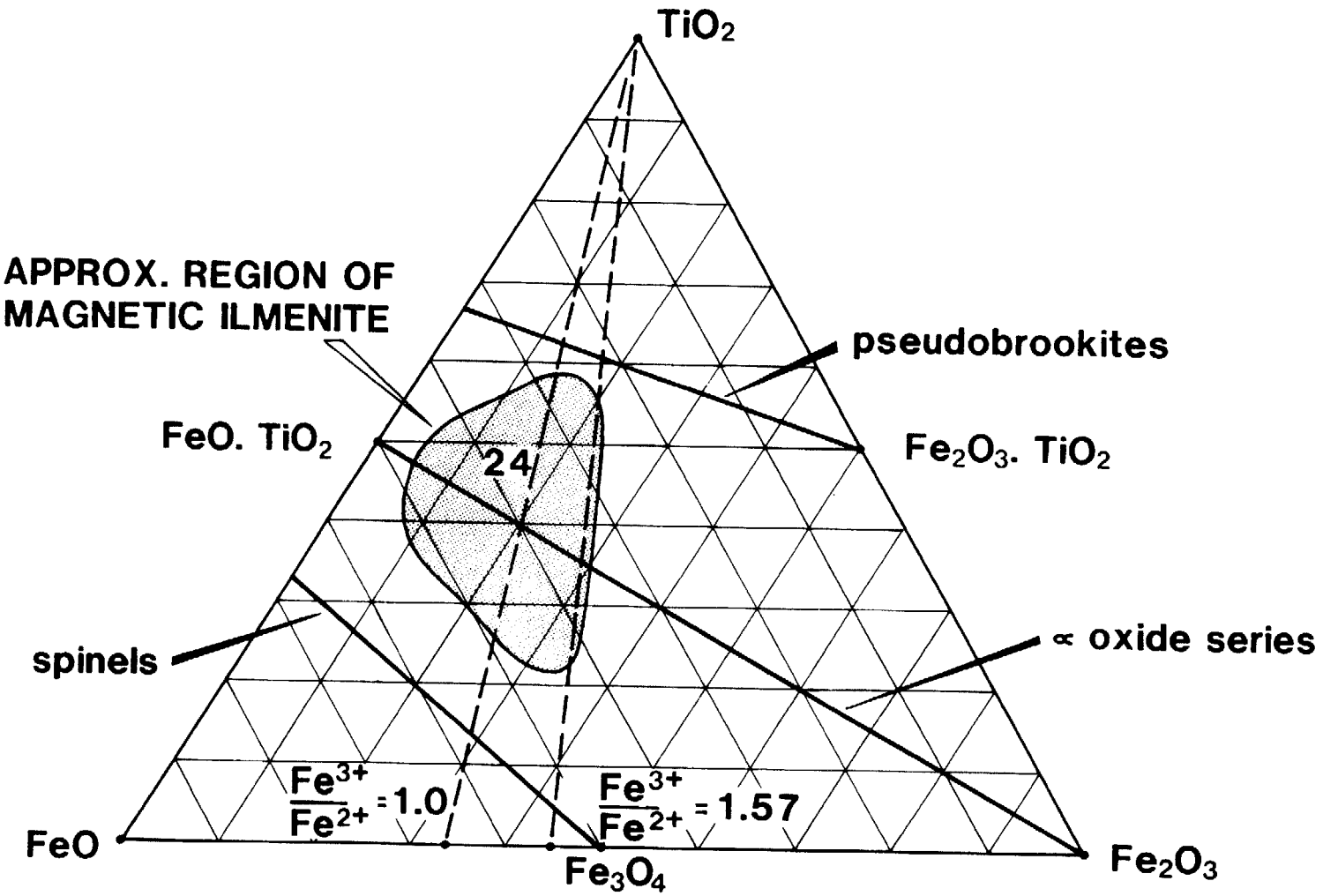
FIG. 5 is a Molar Ternary Diagram of the $TiO_2$-FeO-$Fe_2O_3$ system.

The invention stabilizes the roasting reaction in the zone of maximum magnetic enhancement (FIG. 5) by controlling the oxygen potential so that for an ilmenite with a high $Fe_2O_3$:FeO mole ratio the reaction condition may be reducing, and for an ilmenite with a low $Fe_2O_3$:FeO mole ratio the reaction condition may be oxidizing. Others (Bozorth et al, Ishikawa, or Curnow & Parry) have established that maximum magnetic enhancement is achieved when the mole ratio $Fe_2O_3$:FeO is within the range 1:1 and 1.57:1 (shaded region 24 in FIG. 5). For most ilmenites the reaction condition is mildly oxidizing.

The reaction stability is achieved by using excess carbon fuel mixed with the ilmenite feed stock and combusted with air in amounts so that the amount of oxygen in the exit gas is readily maintained at the level most suited to the particular ore type being processed. In most cases this will be within the range 0.1% to 1.0%.$O_2$ by volume of the exit gases.

Thus the invention is applicable to ilmenites of different composition such as, but not restricted to, the examples shown in Table 2 below.

TABLE 2

| | % BY WEIGHT | |
|---|---|---|
| EXAMPLE | FeO | $Fe_2O_3$ |
| 1. Westport (New Zealand) | 37.6 | 3.2 |
| 2. Richards Bay (S. Africa) | 22.5 | 25.0 |
| 3. West Australia | 24.0 | 18.0 |
| 4. West Australia | 33.9 | 13.2 |
| 5. Queensland | 18.8 | 21.9 |
| 6. New South Wales | 16.2 | 22.6 |

Figure 6A:
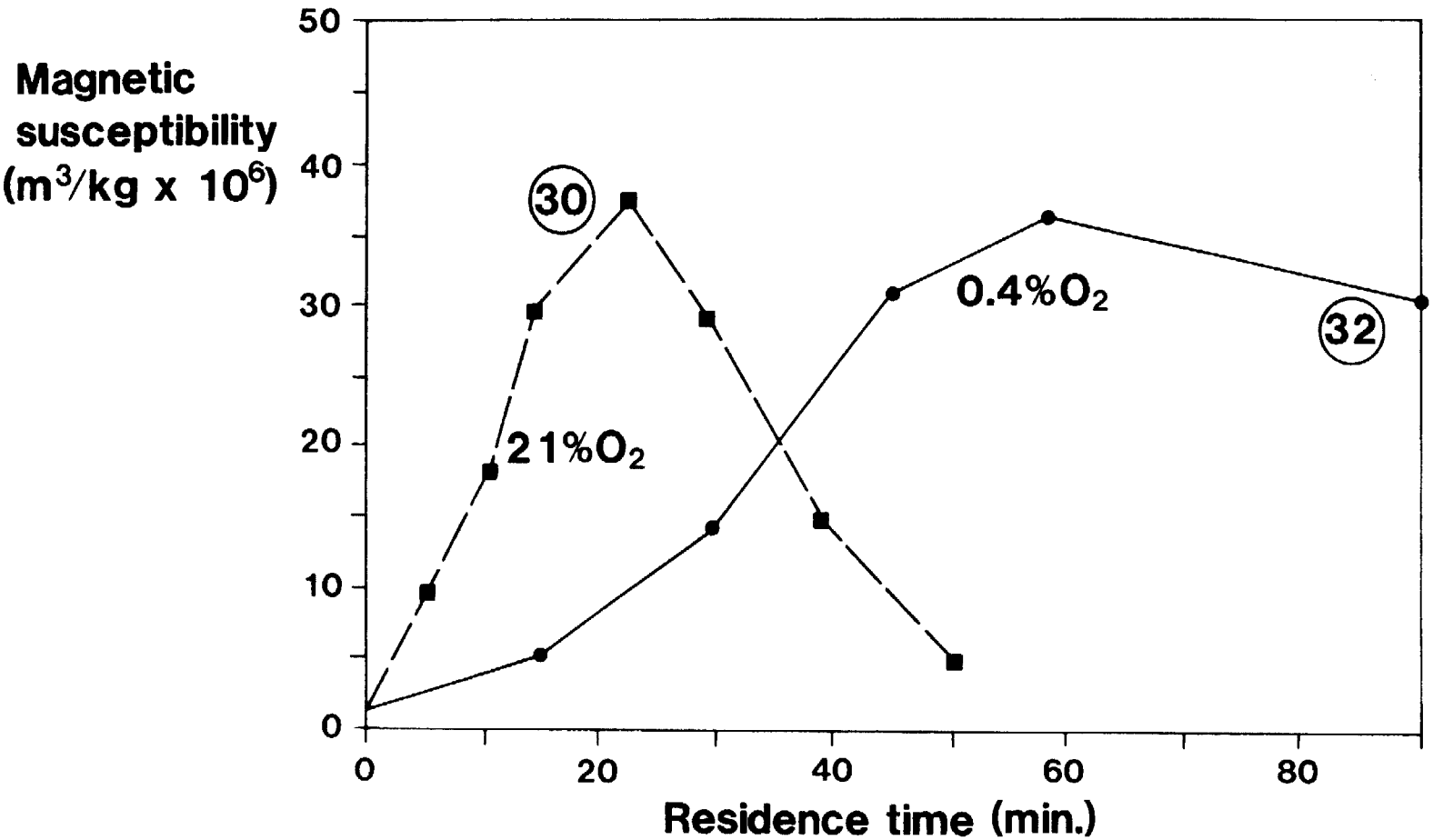
FIGS. 6(*a*)–(*c*) compare the stability of the inventive process to that of the prior art at various roasting temperatures.
Figure 6B:
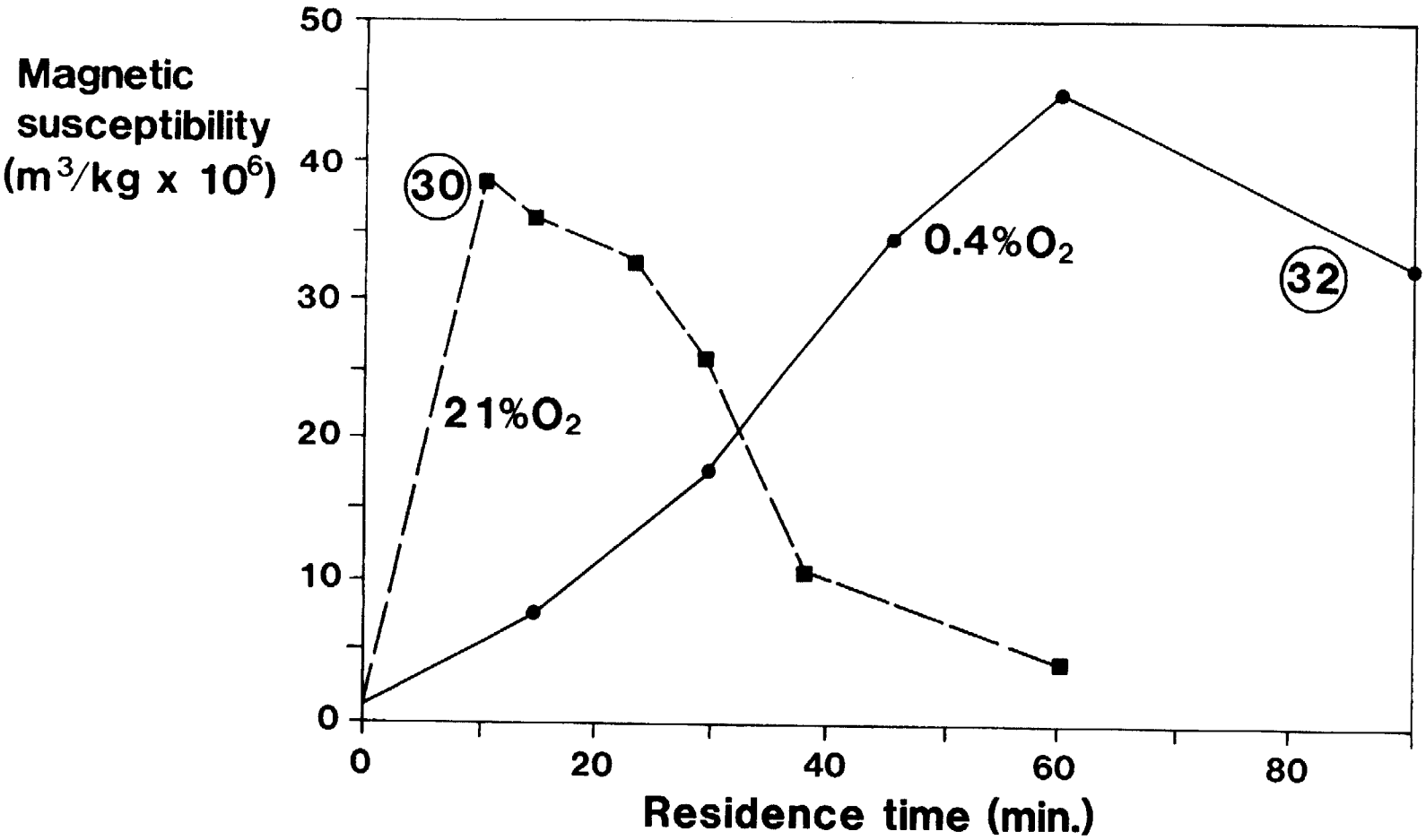
Figure 6C:
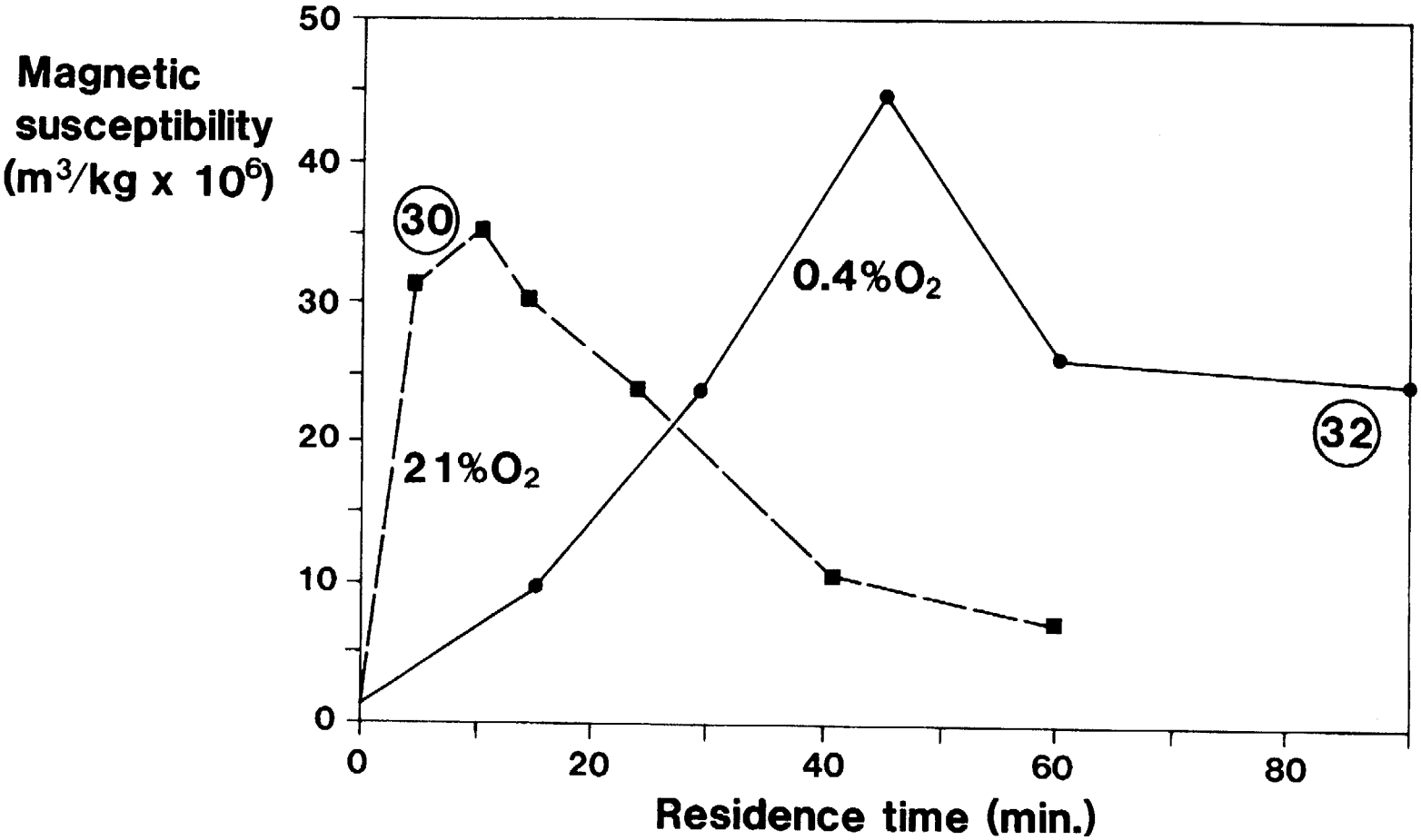

FIG. 6 illustrates the difference in results achieved from a reaction that is not buffered by excess carbon and one that is. The unbuffered reaction results in a sharp curve 30 as compared to the smoother curve 32 for the buffered reaction according to the invention thus allowing better control in plant practice.

FIGS. 6(*a*)–(*c*) plot the magnetic susceptibility versus roasting time at roasting temperatures respectively of 750° C., 800° C. and 850° C. Each curve 30, shown in broken line, demonstrates that the resultant susceptibility as a function of time using high percentage oxygen atmosphere roast employed in the prior art peaks and then falls within a narrow time window. The prior art is thus more susceptible to an inconstant result or requires more rigid control. The process according to the invention is graphed in curves 32, shown in unbroken line, from which it is clear that maximum susceptibility is achieved more gradually tending to a plateau with time. This result provides a more efficent and more easily controlled process compared to the prior art.

Throughout the specification the term "carbon" while including carbon per se (e.g. charcoal) includes "carbon containing" or carbonaceous compounds, for example CO, CO+steam, or hydrocarbon fuels in addition to or in place of the char used in the examples described herein. The excess of carbon used may thus be in part supplied by the fluidising gas and/or the bed of the roaster.

In one series of experimental tests, the following parameters were used:

| | |
|---|---|
| Feed to roaster | 5000 g Heavy mineral concentrate<br>1000 g Recycled char<br>600 g Bituminous coal |
| Temperature of roaster bed | 800° C. |
| Residence time in roaster | 60 minutes |
| Fluidising gas | Air |
| Roaster atmosphere (exhaust) | 0.3% to 0.5% $O_2$ |

After roasting under these conditions, it was possible to separate "magnetically enhanced ilmenite" from the gangue minerals at better than 98% recovery of the ilmenite component, using a low intensity magnetic separator.

The mass magnetic susceptibility ($10^{-6}$ $m^3$/kg) at a field strength×field gradient of 1,0 $T^2$/m of the roaster feed and product were as follows:

TABLE 3

| | Ilmenite | Garnet |
|---|---|---|
| Roaster Feed | 0.9 | 0.9 |
| Roaster Product | 50.0 | 0.9 |

The heavy mineral concentrate used for the example cited above was specifically westport (New Zealand) concentrate but similar results were obtained in other experimental tests using other ilmenites which did not contain silicate inclusions and hence did not require a grinding stage (step 7), and subsequent magnetic separation stage, (step 8). That is, only a low to medium intensity magnetic separation stage was necessary after roasting. In one such case the mass magnetic susceptibility was measured at 85.

Figure 4:
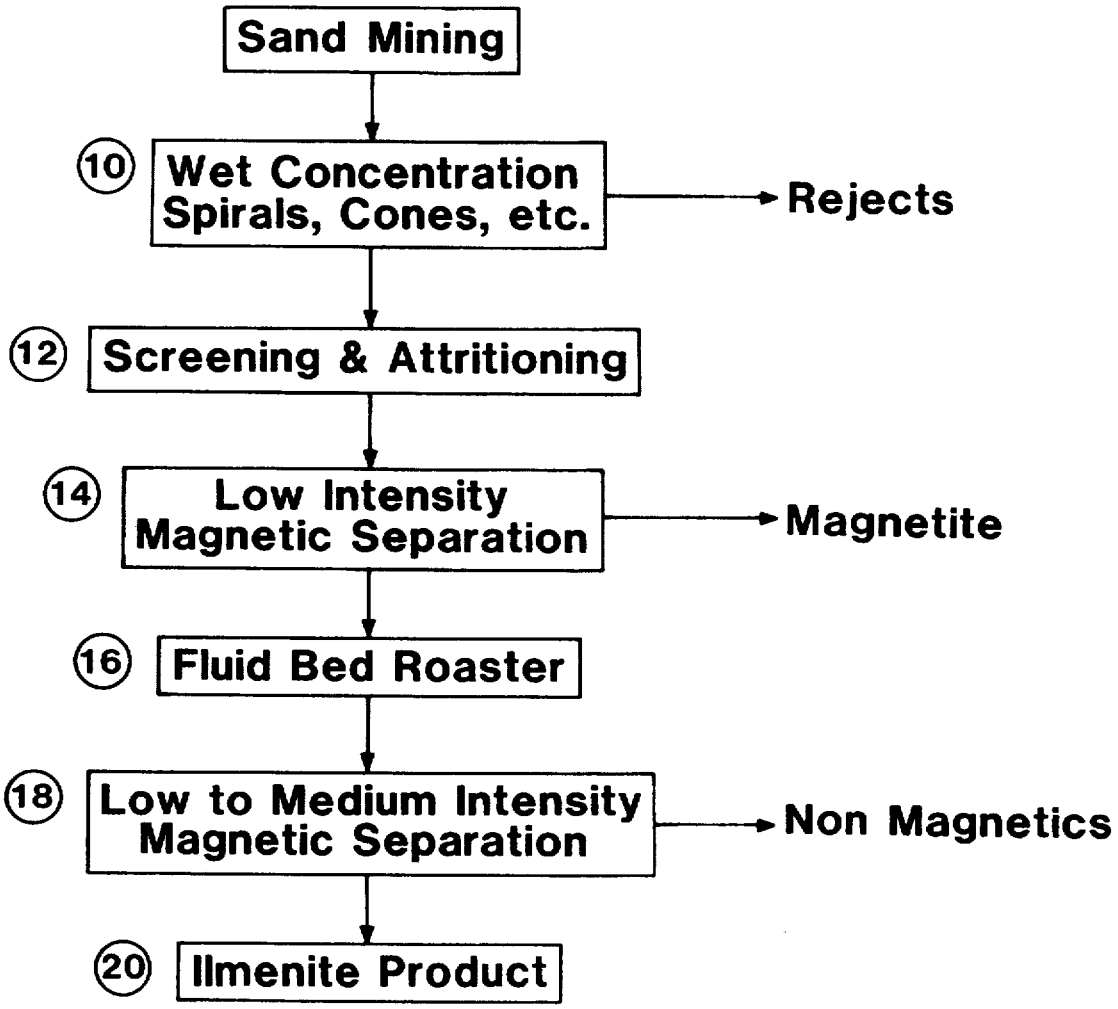
FIG. 4 is a block diagram of a second embodiment of the process according to the present invention.

Thus a second embodiment of the invention, as shown in FIG. 4 includes conventional stages of gravity separation (10), screening and attritioning, (12), followed by a low intensity magnetic separation stage, (14), to remove highly magnetic materials such as magnetite. Subsequent roasting, (16), followed by a low to medium intensity magnetic separation stage, (18), results in a high recovery of ilmenite, (20).

In addition to providing a mechanism whereby ilmenite can be readily and economically recovered from mineral sands in general and recovered and upgraded and separated from garnet in the particular case of West Coast, South Island, New Zealand ores, or separated from deleterious chromite and/or chrome spinels as is the particular case of Eastern Australian ilmenite, the invention provides a single stage roasting reaction which has the additional effect of pretreating the ilmenite so that the reactivity of ilmenite is enhanced and the mineral thereby made amenable to synthetic rutile production by selective leaching of its iron content by hydrochloric acid. Other known processes in the prior art require multiple stage roasting to achieve the same effect.

Yet a further improvement in the magnetic susceptibility has been found to result from controlling the rate of cooling of the roasted product.

For example, in one series of tests, four identical samples of ilmenite were roasted for 90 minutes in separate runs using an excess of coal/char as fuel as previously described. Two runs were conducted at 800° C. and two at 850° C.

At the completion of the roasting, one of each of the separate temperature runs was rapidly quenched in a water bath, while each of the remaining samples was cooled gradually to ambient temperature (annealed) over a period of 90 minutes.

When cooled, each of the four samples was cleaned of residual char, magnetically separated from gangue minerals and tested for magnetic susceptibility, with the results shown in Table 4.

TABLE 4

| | Mass magnetic susceptibility ($10^{-6}m^3/kg$) at a field strength × field gradient of $1,0T^2/m$ | |
|---|---|---|
| Roasting Temperature | 800° C. | 850° C. |
| Quenched | 38 | 60 |
| Annealed | 58 | 76 |

Figure 7:
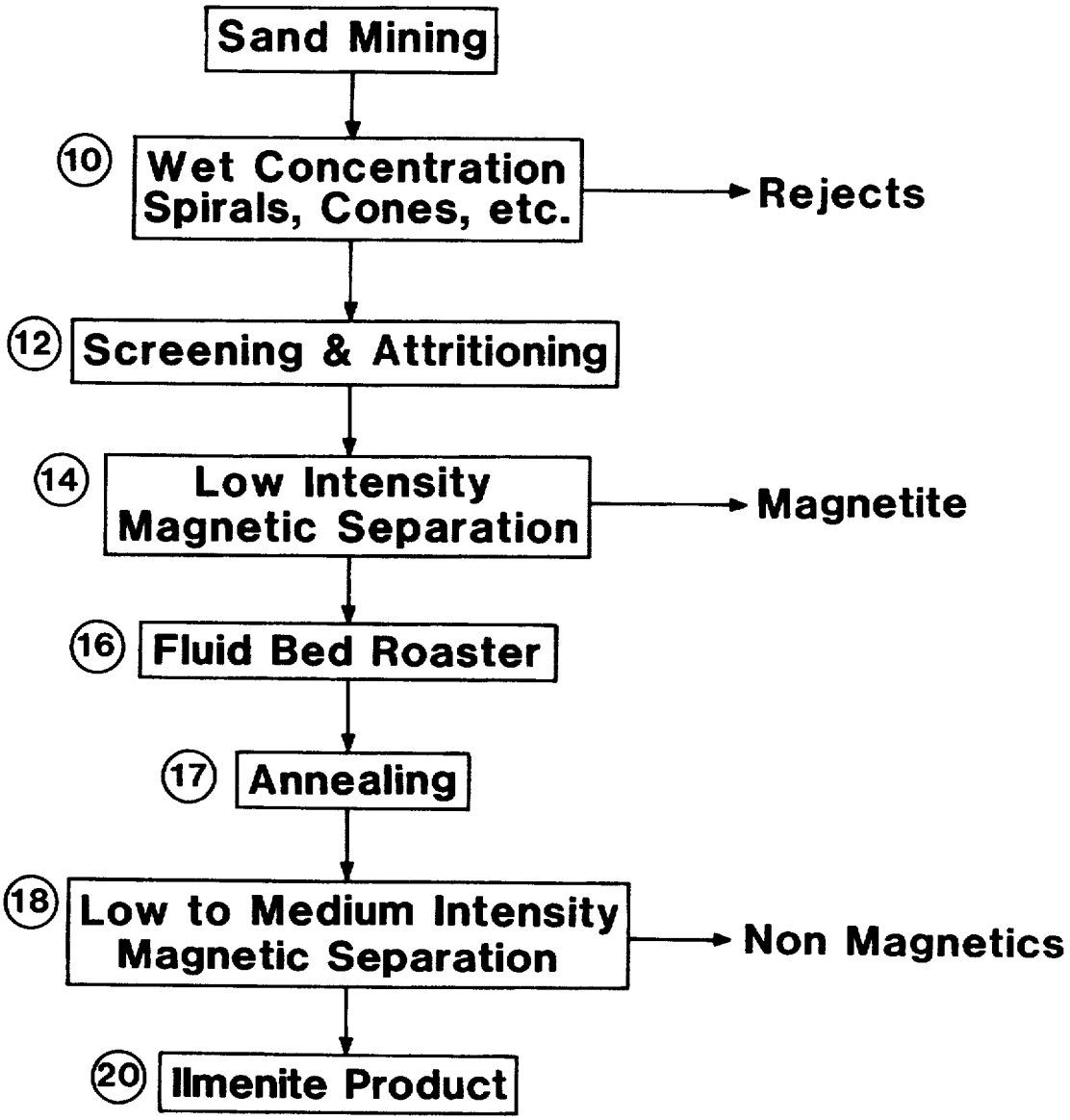
FIG. 7 is a block diagram of a third embodiment of the process according to the present invention.

Therefore, a third embodiment of the invention comprises the steps set out in FIG. 7 where in between the steps of roasting 16 and magnetic separation 18 an annealing step 17 is performed as described above. Annealing, i.e. a controlled rate of cooling of the roasted product, compared to quenching, enables an improved recovery of the roasted ilmenite in the magnetic separation stage due to the further improvement in magnetic susceptibility.

Though the invention has been described above with respect to preferred embodiments thereof it is to be understood that variations in the above-described method are contemplated within the knowledge of a person skilled in the art. For example, the roasting temperature, atmosphere and residence time of step 4 of FIG. 2, or step 16 of FIG. 4 can be varied within parameters determined by suitable experimentation. In addition, the grinding stage of step 7, when required, can be varied within parameters determined by suitable experimentation. In addition, the grinding stage of step 7 of FIG. 2 is carried out to produce grains in the range from minus 125 microns to plus 75 microns together with the grading of the resultant product. It is contemplated that these ranges are not absolute but relative to the feed stock and are determinable by experiment within the knowledge of a person skilled in the art.

I claim:

1. A process for the separation of ilmenite from raw sand or mineral concentrates thereof, comprising the steps of:

a specific gravity separation stage;

a low intensity magnetic separation stage;

a single stage magnetizing roast for magnetically enhancing ilmenite at a temperature in the range of 650° C.–900° C. using an excess of carbon fuel for providing an atmosphere in which the oxygen potential for oxidation or reduction dependent on mole ratio of the ilmenite is controlled; and, a low to medium intensity magnetic separation stage.

2. The process according to claim 1, further comprising the step of:

cooling a product resulting from said roasting stage prior to said low to medium intensity magnetic separation stage.

3. The process according to claim 2, further comprising the steps:

a grinding stage; and, a low to medium intensity wet magnetic separation stage, said grinding stage and said low to medium intensity wet magnetic separation stage being subsequent to said magnetic operation stage.

4. The process according to claim 3, wherein said single stage magnetizing roast is performed in a fluidized bed roaster.

5. The process according to claim 3, wherein said excess of carbon includes bituminous coal and recycled char.

6. The process according to claim 5, wherein said single stage magnetizing roast is performed in a fluidized bed roaster.

7. The process according to claim 5, wherein said atmosphere is controlled to have an oxygen concentration in exit gases of 0.1% to 1.0% by volume.

8. The process according to claim 7, wherein said single stage magnetizing roast is performed in a fluidized bed roaster.

9. The process according to claim 7, wherein said roasting atmosphere is air.

10. The process according to claim 9, wherein said single stage magnetized roast is performed in a fluidized bed roaster.

11. The process according to claim 9, wherein said roasting temperature is in the range of 750° C.–850° C.

12. The process according to claim 11, wherein said single stage magnetizing roast is performed in a fluidized bed roaster.

13. The process according to claim 11, wherein said roasting stage is performed for a residence time of 30–90 minutes.

14. The process according to claim 13, wherein said single stage magnetizing roast is performed in a fluidized bed roaster.

15. The process according to claim 13, wherein said cooling step comprises cooling a product for a period of 90 minutes.

16. The process according to claim 15, wherein said single stage magnetizing roast is performed in a fluidized bed roaster.

17. The process according to claim 2, wherein said excess of carbon includes bituminous coal and recycled char.

18. The process according to claim 17, wherein said single stage magnetizing roast is performed in a fluidized bed roaster.

19. The process according to claim 17, wherein said atmosphere is controlled to have an oxygen concentration in exit gases of 0.1% to 1.0% by volume.

20. The process according to claim 19, wherein said single stage magnetizing roast is performed in a fluidized bed roaster.

21. The process according to claim 19, wherein said roasting temperature is air.

22. The process according to claim 1, wherein said single stage magnetizing roast is performed in a fluidized bed roaster.

23. The process according to claim 21, wherein said roasting temperature is in the range of 750° C.–850° C.

24. The process according to claim 23, wherein said single stage magnetizing roast is performed in a fluidized bed roaster.

25. The process according to claim 23, wherein said roasting stage is performed for a residence time of 30–90 minutes.

26. The process according to claim 25, wherein said single stage magnetizing roast is performed in a fluidized bed roaster.

27. The process according to claim 25, wherein said cooling step comprises cooling a product for a period of 90 minutes.

28. The process according to claim 27, wherein said single stage magnetizing roast is performed in a fluidized bed roaster.

29. The process according to claim 2, wherein said single stage magnetizing roast is performed in a fluidized bed roaster.

30. The ilmenite ore produced according to the process of claim 1.

31. The process according to claim 1, wherein said single stage magnetizing roast is performed in a fluidized bed roaster.

* * * * *